US006662522B2

(12) United States Patent
Nichols et al.

(10) Patent No.: US 6,662,522 B2
(45) Date of Patent: Dec. 16, 2003

(54) GYPSUM BOARD HANGING TOOL

(75) Inventors: Travis R. Nichols, Perry, UT (US); JaDee B. Moncur, Perry, UT (US); W. Blake Gustafsen, Provo, UT (US)

(73) Assignee: Mimix, Inc., Lovell, WY (US)

( * ) Notice: Subject to any disclaimer, the term of this patent is extended or adjusted under 35 U.S.C. 154(b) by 169 days.

(21) Appl. No.: 09/802,657

(22) Filed: Mar. 9, 2001

(65) Prior Publication Data

US 2002/0124523 A1 Sep. 12, 2002

(51) Int. Cl.[7] ..... E04F 21/00

(52) U.S. Cl. ..... 52/747.1; 52/749.1; 52/749.13; 81/463; 81/488

(58) Field of Search ..... 52/DIG. 1, 749.1, 52/747.1, 749.13; 81/46, 463, 488; 269/3, 6, 46, 47–52, 55–85, 86, 87, 87.2, 87.3, 88–104, 107–154, 216–286, 315, 289 R–314 R, 289 MR, 900, 901, 904

(56) References Cited

U.S. PATENT DOCUMENTS

| | | | | | |
|---|---|---|---|---|---|
| 3,910,421 | A | | 10/1975 | Panneton | 214/1 |
| 3,930,645 | A | | 1/1976 | Anderson | 269/289 |
| 4,120,484 | A | | 10/1978 | Zimmer | |
| 4,133,097 | A | * | 1/1979 | Slade, deceased | 29/564.8 |
| 4,158,455 | A | | 6/1979 | Brown | |
| 4,375,934 | A | | 3/1983 | Elliott | 414/11 |
| 4,576,354 | A | | 3/1986 | Blessing, Sr. | |
| 4,600,348 | A | | 7/1986 | Pettit | |
| 4,646,996 | A | | 3/1987 | Comstock | 248/165 |
| 4,649,677 | A | * | 3/1987 | Oldham | 52/90.1 |
| 4,672,787 | A | * | 6/1987 | Murphy | 52/409 |
| 4,709,527 | A | | 12/1987 | Cooley | |
| 4,826,390 | A | | 5/1989 | Paxton | 414/11 |
| 4,867,403 | A | | 9/1989 | Anderson | 248/216.1 |
| 5,002,446 | A | | 3/1991 | Anderson | 411/400 |
| 5,129,774 | A | | 7/1992 | Balseiro et al. | |
| 5,163,799 | A | | 11/1992 | Lynn | 414/11 |
| 5,249,405 | A | | 10/1993 | Miller | |
| 5,329,744 | A | * | 7/1994 | Sumter | 52/749.1 |
| 5,655,337 | A | | 8/1997 | Bryant et al. | 52/127.2 |
| 5,692,357 | A | * | 12/1997 | McCain | 52/749.1 |
| 5,979,854 | A | | 11/1999 | Lundgren et al. | 248/354.3 |
| 6,176,063 | B1 | * | 1/2001 | Warin | 52/749.1 |

* cited by examiner

*Primary Examiner*—Jeanette Chapman
(74) *Attorney, Agent, or Firm*—Kirton & McConkie; Michael F. Krieger

(57) ABSTRACT

The present invention relates to a gypsum board hanging tool that allows a single workman to hang gypsum board on a conventional or inclined ceiling. Specifically, the gypsum board hanging tool comprises a support housing, a wheel that is rotatably attached to the support housing, and a support strut which is removably attached to at least one extension of the support housing. The support housing also has a means whereby a support strut may be attached. The support housing also has a means an aperture in its upper surface that is capable of receiving, within the support housing, a hanging member, such as a nail or screw, that is first attached to a ceiling or a wall. The hanging member allows the support housing to be suspended from the ceiling and to adjust and swivel about the hanging member. Finally, the support housing also has a coupling actuator that is located within and attached to its interior that functions to engage the hanging member and suspend the system and a piece of gypsum board from the ceiling. Coupling actuator further includes a release mechanism, or quick release, that releases the hanging member from the support housing upon attachment of the gypsum board to the ceiling. Also included is a method for hanging gypsum board, wherein a single workman may use the gypsum board hanging tool to hang multiple pieces on the ceiling using the tool's swivel capabilities. Finally, included in the system is a cam actuator, which facilitates or causes a piece of gypsum board to be pressed against the ceiling prior to being hanged.

20 Claims, 10 Drawing Sheets

GYPSUM BOARD HANGING TOOL

BACKGROUND

1. Field of the Invention

The present invention generally relates to a system and device for hanging a panel, such as drywall or gypsum board, on a wall or a ceiling. Specifically, the present invention relates to a gypsum board hanging tool and system for assisting in lifting and suspending a piece of gypsum board in an elevated position where the piece of gypsum board may be accurately adjusted and manipulated into a final position for attachment to a wall or ceiling. The present invention also specifically relates to a gypsum board hanging tool that is portable and that may be used by a single individual to hang gypsum board on a ceiling.

2. Description of the Prior Art

In building structures, supporting joists, rafters, studs, or the framing members of ceilings and walls are often overlaid with a plurality of gypsum panels generally referred to as dry wall or gypsum board. Other types of panels may also be used to construct wall and ceilings in building structures. In any event, gypsum board panels are usually bulky and heavy and difficult to handle because of their size and weight. As such, it often requires multiple individuals to secure these panels to the supporting joists, rafters, studs, or other framing members that exist in building structures. It is particularly difficult to apply gypsum board to ceilings, either conventional or having inclined edges, because the individuals must lift the gypsum board panels to an overhead position to securely fasten or attach them to the ceiling. Multiple individuals or workmen are required because each panel needs to be accurately positioned before it can be secured or attached to the ceiling.

Because gypsum board is very large, awkward, and heavy, making it nearly impossible for one person to hang a sheet on the ceiling and extremely difficult for two people to hang a sheet on a ceiling, the addition of a second workman greatly increases the cost of hanging gypsum board in a building structure. To try and reduce costs, several devices have been created to assist a single workman in hanging dry wall on a ceiling.

Once such device that is used in the industry is a lifting and supporting device, which includes a head piece having two brackets that attach to a joist of a ceiling. The head piece also includes two elongated members that are used to support a piece of gypsum board or dry wall that may be overlaid thereon. To hang the piece of gypsum board on the ceiling, the piece of gypsum board is laid upon the supports and the brackets are then attached or placed over the ceiling joists in a particular position. The two supports are pivotally attached to the head piece so that as the brackets are placed upon a ceiling joist, the opposing end is left resting on the ground. After the piece of dry wall is in place, the opposing end that is resting on the ground may then be lifted up to the ceiling by a single workman wherein the opposing end is supported using some type of a prop wedged between the device and the ground. This type of device is limited in several ways. First, the device may only be used on a ground or an above-ground level where ceiling joists are positioned and are part of the building structure. The device may not be used in basements where no joists exist because there is nothing that the head piece may attach to. Second, the opposing end must be supported by a prop, which creates an obstacle that is resting on the ground that the workman must be constantly aware of and avoid knocking over so that the opposing end of the device does not accidentally fall to the ground destroying the piece of gypsum board and possibly injuring the workman. Finally, the device is also bulky and heavy and requires a substantial amount of set-up time and is not easily carried.

Another method or device used by single workmen to hang a piece of drywall on a ceiling is a hoist mechanism. Several different designs exist with each possessing similar characteristics. Namely, they each require a contact with the ground and some type of a base unit that supports the piece of dry wall. Each of these systems or devices also use some type of a hydraulic or mechanical lift or other means wherein the supported gypsum board may be lifted to the ceiling using a crank or screw or other mechanism. The workmen simply places the piece of gypsum board over the support portions of the device after positioning them in the proper place and then raises the piece of gypsum board to the ceiling using the type of lift mechanism employed in the device. Once the piece of drywall is lifted to the ceiling, it may then be attached. These types of lifting devices also have many disadvantages. They too require substantial contact with the floor. These devices are also bulky, have many parts, and often require the use of a trailer or other means for transporting the devices to and from job sites. Moreover, these types of devices can be quite inefficient as time is required to move each piece to the appropriate position and actuate the lift mechanisms necessary to raise the piece of drywall to the ceiling.

Accordingly, what is needed is a tool that a single individual or workman may use to hang dry wall in an efficient and cost effective manner. Specifically, what is needed is a gypsum board tool that is easy to assemble that requires no floor support and that allows for adjustment of an overlaid piece of gypsum board to be accurately moved into a proper position prior to it being permanently attached to a ceiling.

SUMMARY AND OBJECTS OF THE INVENTION

An object of the present invention is to provide an easy to use gypsum board hanging tool that a single workman may use to hang gypsum board on the ceiling.

Another object of the present invention is to provide a tool that requires no ground support, but rather suspends the piece of gypsum board from the ceiling prior to attachment.

Still another object of the present invention is to provide a tool that is easily portable, fits in a standard toolbox, and is adaptable to any size panel of gypsum board.

It is further an object of the present invention to provide a gypsum board hanging tool that allows accurate placement of the pieces of gypsum board into a final position prior to attachment to a ceiling.

It is still further an object of the present invention to provide a tool that allows a single workman to hang several pieces of gypsum board in any building structure and on any level in a quick, easy, cost-effective, and safe manner.

It is still further an object of the present invention to provide a tool that facilitates the hanging of gypsum board on a conventional or inclined ceiling or surface.

To achieve the foregoing objects, and in accordance with the invention as embodied and broadly described herein, the present invention features a gypsum board hanging tool and system that includes a support housing, a wheel that is rotatably attached to the support housing, and a support strut which is removably attached to the support housing. The support strut is substantially flush with the face of the support housing in the preferred embodiment, meaning the face of the support housing may be recessed a distance from the support strut, or the face of the support housing may be flush with the support strut if desired.

The support housing itself has an upper surface, a lower surface, and a face. The support housing also has a means whereby a support strut may be attached. The support housing also has an aperture in its upper surface that is capable of receiving, within the support housing, a hanging member that is first attached to a ceiling or a wall. The hanging member allows the support housing to be adjustable and to swivel about the hanging member. Finally, the support housing also has a coupling actuator that is located within and attached to its interior. The coupling actuator is capable of engaging and securing the hanging member within the support housing, wherein the support housing may be coupled to the hanging member, thus suspending the gypsum board hanging tool and system from the ceiling. Coupling actuator further includes a release mechanism, or quick release, that releases the hanging member from the support housing upon attachment of the gypsum board to the ceiling.

The present invention also features a method for hanging paneled members on a ceiling. The method includes: inserting a first and second hanging member into said ceiling; overlaying said paneled member onto a gypsum board hanging tool, said gypsum board hanging tool comprising a first and second support housing removably attached to opposing ends of a support strut, an aperture for receiving said hanging member, a coupling actuator located within and attached to said first and second support housing, said coupling actuator engaging said first hanging member within said support housing, and at least one stabilizer removably or permanently attached to and extending from said support housing for supporting said paneled member; positioning said gypsum board hanging tool to a first position; lifting first support housing of said gypsum board hanging tool and overlaid paneled member to said first hanging member; coupling said first support housing to said first hanging member using said coupling actuator; lifting said second support housing and overlaid paneled member to said second hanging member; coupling said second support housing to said second hanging member using said coupling actuator, thus suspending said gypsum board hanging tool and paneled member from said ceiling using said first and second said hanging members; manipulating said gypsum board hanging tool and said paneled member to a proper position; and permanently attaching said paneled member to said ceiling.

The method further comprises the steps of: inserting a third hanging member into said ceiling; releasing said first support housing from said first hanging member using a release mechanism of said coupling actuator; swiveling said gypsum board hanging tool to a second position; overlaying a second paneled member onto said gypsum board hanging tool; lifting said first support housing to said third hanging member; and coupling said first support housing to said second hanging member using said coupling actuator, thus suspending said gypsum board hanging tool and said paneled member from said ceiling using second and third hanging members. These steps may be repeated as often as necessary to hang multiple pieces of gypsum board on a ceiling.

Finally, the present invention features, in an alternative embodiment, a cam actuator that causes a paneled member to be pressed against a ceiling joist prior to permanently attaching. The cam actuator is rotatably coupled to a support housing that is itself is slidably coupled to a receiver that receives a support strut.

Upon completion of the job and after all paneled members are hung, the gypsum board hanging tool may be collapsed to fit into a standard toolbox. Specifically, the coupling actuator is deactuated using the release mechanism or quick release. This causes the engagement member of the coupling actuator to disengage thereby releasing the support housing from the hanging member. The plurality of stabilizers may then be removed from the support housing, followed by the removal of each support housing from the support strut. This provides a compact, easy to install and takedown portable hanging tool.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE PREFERRED EMBODIMENTS

It will be readily understood that the components of the present invention, as generally described and illustrated in the figures herein, could be arranged and designed in a wide variety of different configurations. Thus, the following more detailed description of the embodiments of the system and method of the present invention, and represented in FIGS. 1 through 7, is not intended to limit the scope of the invention, as claimed, but is merely representative of the presently preferred embodiments of the invention.

The presently preferred embodiments of the invention will be best understood by reference to the drawings, wherein like parts are designated by like numerals throughout.

Figure 1:
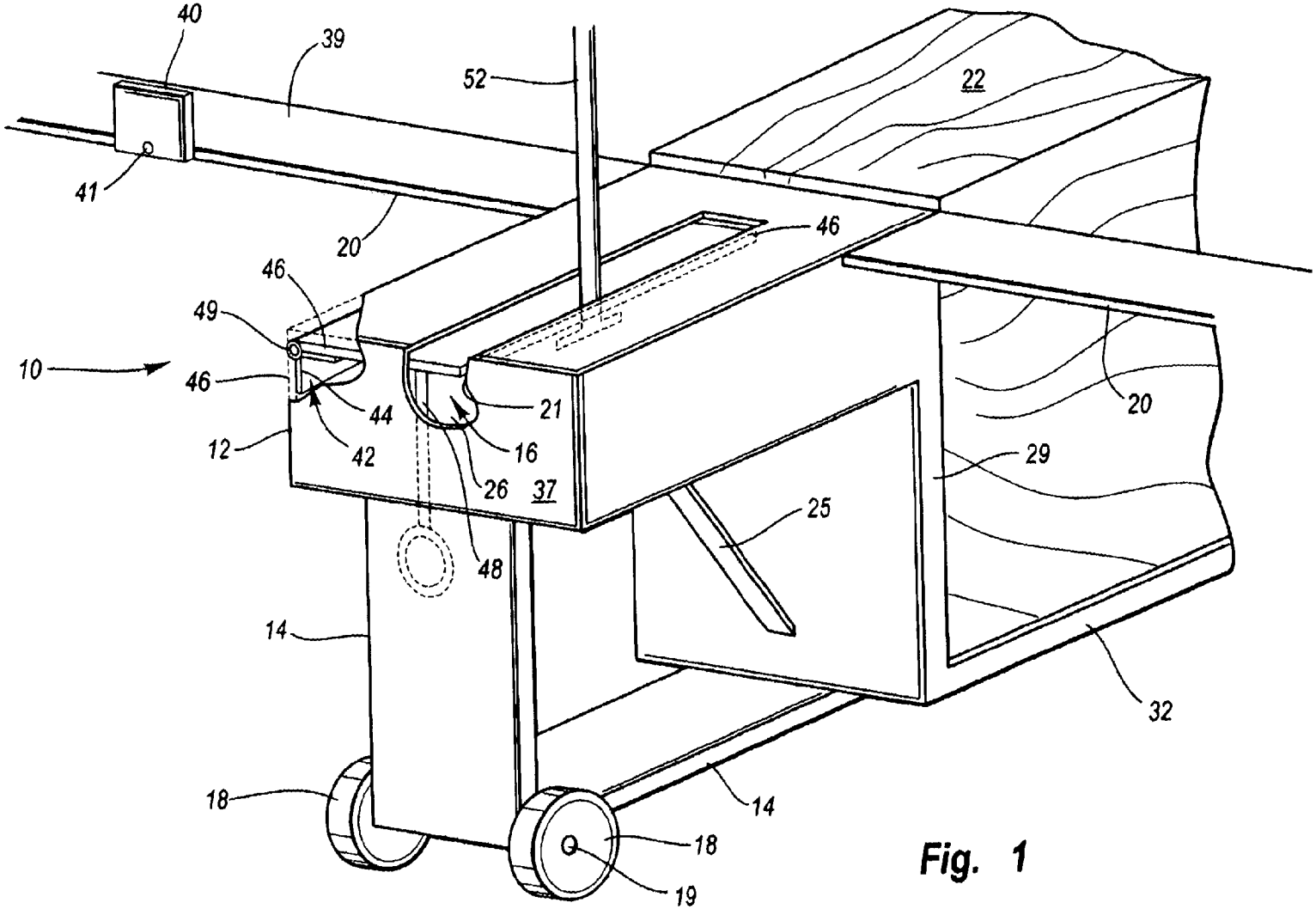
FIG. 1 illustrates an isometric view of one end of the gypsum board hanging tool depicting specifically the support housing and the support strut.
Figure 2:
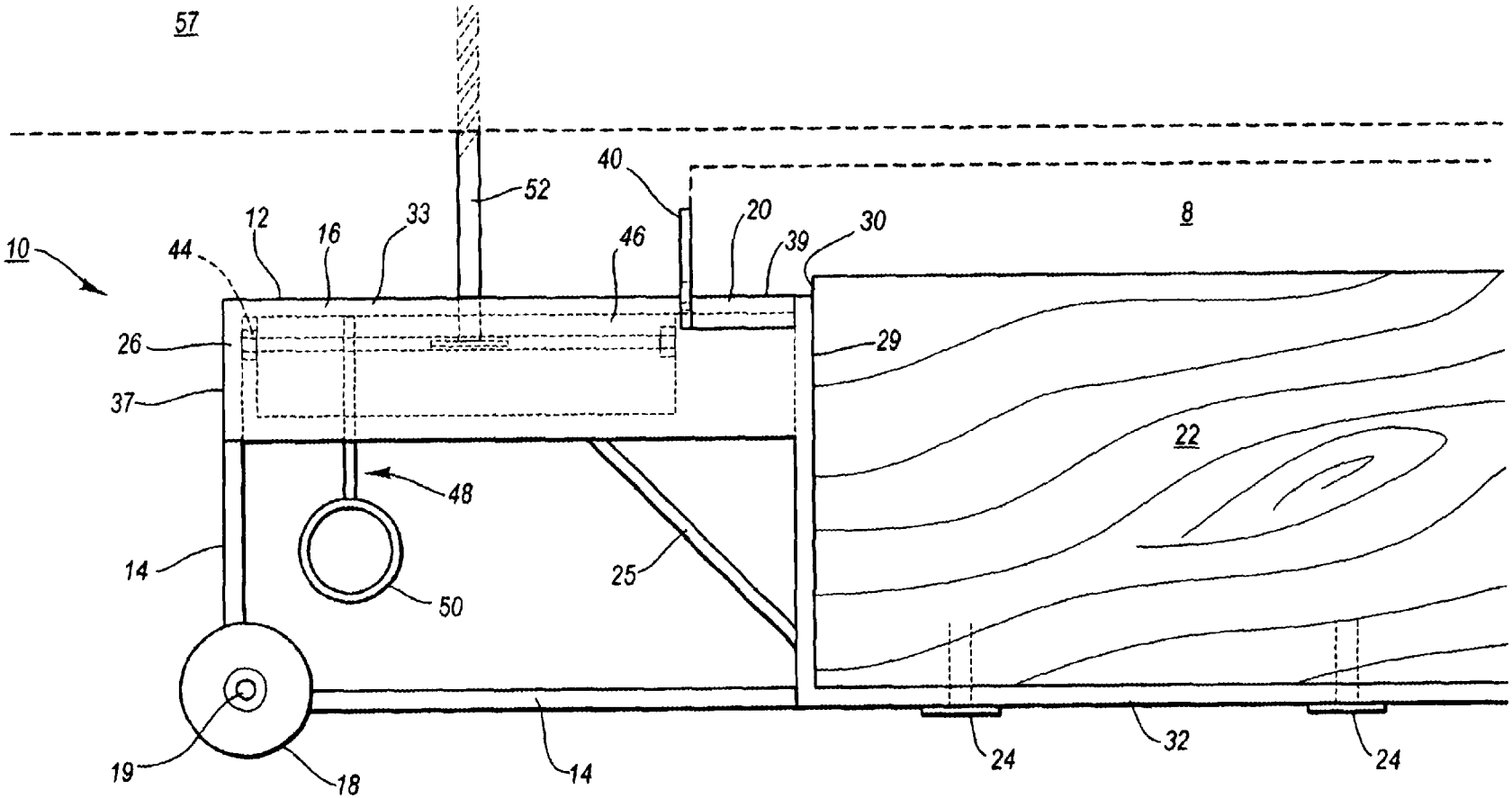
FIG. 2 illustrates a side view of the preferred embodiment of the present invention depicting the support housing and its accompanying elements, the support strut, and the coupling actuator and all attachment means.

The present invention generally describes a gypsum board hanging tool and system 10. Generally, FIGS. 1 and 2 illustrate support housing 12 removably attached to support strut 22. Support housing 12 includes an upper and a lower surface, 33 and 35 respectively, and at least one extension 32 which forms a channel 28. Wheel 18 and handle 14 are also shown attached to support housing 12. Extending from support housing 12 are stabilizers 20 having stoppers 40 rotatably attached thereon. Stoppers 40 serve to secure and hold in place a piece of gypsum board prior to permanent attachment to the ceiling. Also shown in FIG. 1 is aperture 16, which is in the form of a slotted portion having a slot extension 26 extending from slotted portion 16 on upper face 33 down face 37.

FIGS. 1 and 2 further illustrate gypsum board hanging tool 10 having a support housing 12 removably attached to support strut 22 using attachment means 24. Support housing 12 is an elongated member having a first extension 32, which is L-shaped, and a handle 14 also extending therefrom. Support strut 22 abuts support housing 12 at channel stop 29. Support strut 22 is shown as a standard 2"×4" wooden plank, but can be any rigid member known by those in the art possessing properties suitable to support a piece of gypsum board.

In addition, support strut 22 may include or comprise means for telescoping, wherein the support strut may collapse to a compact size for storing, and may extend to any desired length depending upon the particular requirements of the task, while still maintaining a suitable amount of rigidity and support. The telescoping means may include any means known by those ordinarily skilled in the art that is capable of functioning with the technology of the present invention.

Support housing 12 further includes an upper surface 33 wherein aperture 16 which facilitates the coupling of support housing 12 to hanging member 52. Support housing 12 is preferably made of steel, but may be composed of any material known by those in the art. Support housing 12 further includes gusset 25, which is anchored between the lower surface 35 of support housing 12 and first extension 32. Handle 14 completes support housing 12 by extending a distance below support housing 12 and further extending at a substantially 90 degree angle to connect with first extension 32. Wheel 18 is rotatably attached at the apex of handle 14, wheel 18 having an axis 19. Wheel 18 allows hanging tool 10 to be easily moved along a floor or other surface and also aids in the hanging of gypsum board by providing a dolly-like function to gypsum board hanging tool 10 as one end or support housing is lifted to hanging member 52. Also shown in FIGS. 1 and 2 is stabilizer 20, which is removably attached and extends perpendicular from support housing 12. Stabilizer 20 may include a threaded portion wherein it may be screwed into support housing 12, or any other removable attachment means commonly known. Stabilizer 20 serves to support gypsum board 8 as it is overlaid on gypsum board hanging tool 10. The placement or attachment point of stabilizer 20 on support housing 12 is such that when gypsum board 8 is overlaid on the gypsum board hanging tool, it abuts stoppers 40 and allows a substantial portion of support housing 12 to remain uninhibited by gypsum board 8. The portion of support housing 12 that is not covered by gypsum board 8 includes aperture 16 on upper face 33. The reason for placing stabilizer 20 and stopper 40 in this position is so that gypsum board hanging tool 10 may be brought up to and coupled with hanging member 52 inserted into ceiling 57. Stopper 40 is pivotally or rotatably attached to stabilizer 20 using attachment means 41. Stopper 40 is allowed to pivot around the axis of attachment means 41 to allow gypsum board 8 to be adjusted and moved in place prior to permanent attachment to a ceiling.

Once inserted, support housing 12 may freely move about hanging member 52 to properly align gypsum board 8 in a position where it is to be permanently attached to the ceiling. Hanging member 52 is shown coupled to support housing 12, wherein the entire gypsum board hanging tool 10 and accompanying piece of gypsum board 8 remain freely adjustable. One advantage of the adjustability and free movement of support housing 12 about hanging member 52, and gypsum board 8 upon the downward and out of the way rotation of stopper 40, is the ability to freely move and manipulate the suspended piece of gypsum board 8 into an accurate final position for hanging. This is achievable even at the intersection or junction of a wall and ceiling, a conventional flat ceiling, or ceilings having inclined surfaces or edges. The several elements of the tool 10 allow the piece of gypsum board to be accurately positioned for hanging.

Aperture 16 is shown in FIGS. 1 and 2 as a slotted portion extending longitudinally from face 37 to stabilizer 20. The slotted portion provides support housing 12 with a full range of motion as it is coupled to hanging member 52 to insure proper placement and attachment of gypsum board 8. As aperture 16 is shown as a slotted portion, it is not meant to be limiting in any way as one ordinarily skilled in the art would recognize. Further shown in FIGS. 1 and 2 is coupling actuator 42, which is attached to the interior or inside of support housing 12. Coupling actuator 42 includes a biased loading member 44, an engagement member 46, and a release mechanism 48. The coupling actuator 42 allows support housing 12 to be coupled to hanging member 52, thus suspending gypsum board hanging tool 10 and accompanying gypsum board 8 from ceiling 57. Coupling actuator 42 is discussed in greater detail below.

Figure 3:
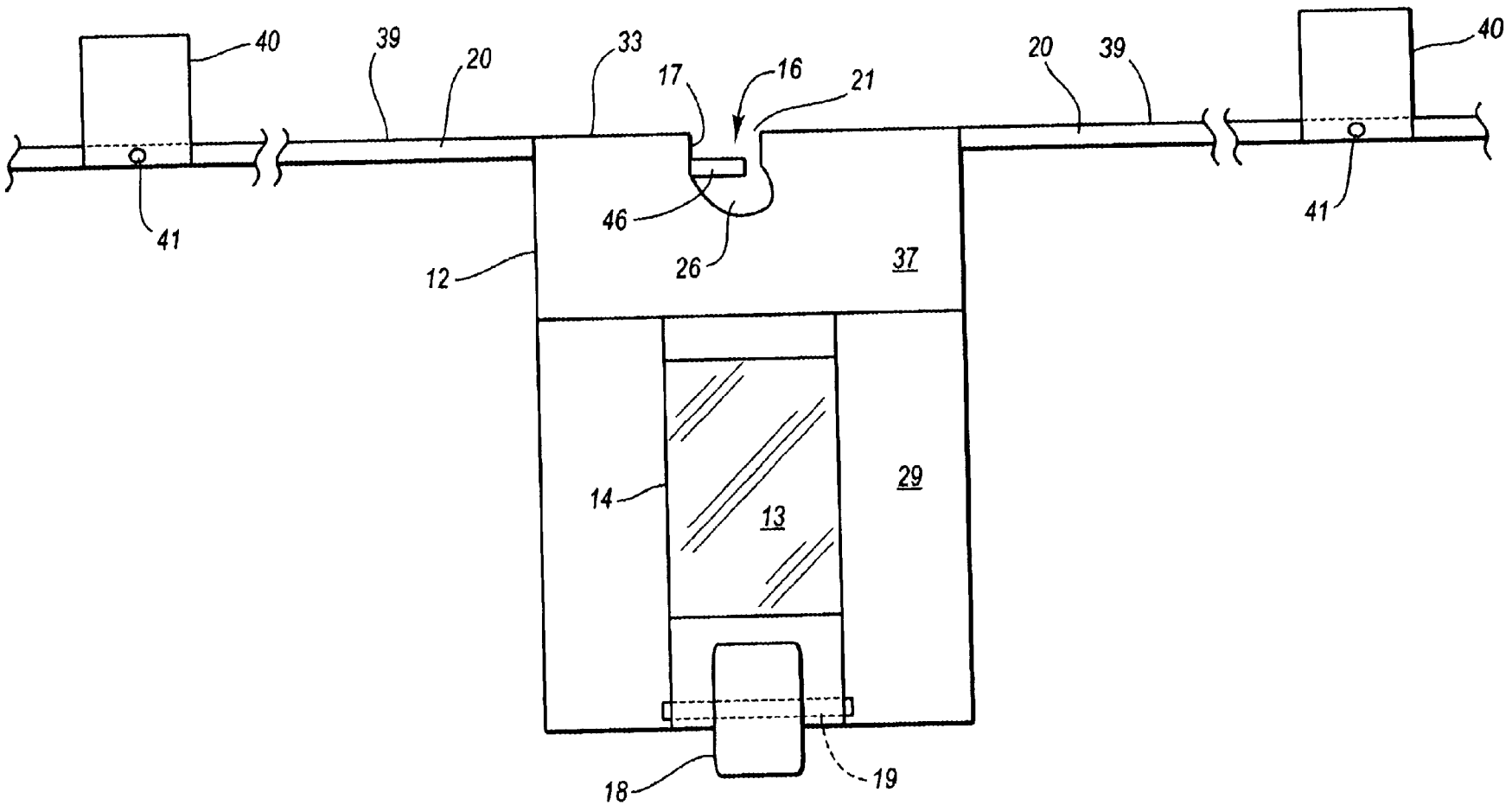
FIG. 3 illustrates a front view of the gypsum board hanging tool according to a preferred embodiment of the present invention.

Referring now to FIG. 3, support housing 12 is shown having stabilizers 20 extending in an opposing directions therefrom and having stoppers 40 rotatably attached thereon along their length. Stoppers 40 pivot about the axis of attachment means 41 such that they may be pivoted down and out of the way as needed to allow a piece of gypsum board to slide past stoppers 40, if needed, to a position for attachment to the ceiling. Stoppers 40 initially serve to secure a piece of gypsum board within tool 10 to keep it from moving during the hanging process. As a piece of gypsum board is overlaid upon tool 10, the ends of the gypsum board abut stoppers 40 which are in an erect or standing state.

The top surface 39 of stabilizers 20 are shown to be flush with the top surface or upper surface 33 of support housing 12. Several or a plurality of stabilizers 20 may be used and attached to support housing 12 to aid in support of a piece of gypsum board. Stabilizers 20 may also be removably attached to support housing 12 such that upon completion of hanging a piece of gypsum board, gypsum board hanging tool 10 may be collapsed wherein stabilizers 20 may be removed form support housing 12. This maintains the portability and compactability of gypsum board hanging tool 10, wherein the entire gypsum board hanging tool may be collapsed to fit in a standard tool box or other carrying or cargo member. As each job is completed, stabilizers 20 and also support strut 22 may be removed from support housing 12. In another embodiment, upper surface 33 of support housing 12 may be slightly recessed from upper surface of support strut 22 to facilitate the movement and adjustability of gypsum board 8 as it is moved to its final position prior to attachment. FIG. 2 depicts this recessed portion shown as recessed portion 30.

FIG. 3 also shows face 37 having slot extension 26. Slot extension 26 is shaped to allow for receiving and nesting of the shaft portion of a hanging member while only one end of gypsum board hanging in tool 10 is attached to the ceiling via hanging member 52 or when hanging member 52 is attached to a wall near the intersection or junction of the wall and the ceiling. Slot extension 26 is an extension of aperture 16, which is shown as slotted portion extending longitudinally along upper surface 33 of support housing 12. Slotted portion or aperture 16 includes edges 17 and 21, respectively. Edge 21 is used in conjunction with engagement member 46 to engage hanging member 52 thereby coupling support housing 12 to hanging member 52 and suspending gypsum board hanging tool 10 from the ceiling.

Also shown in FIG. 3 is handle 14 as it extends in a downward direction from face 37 of support housing 12. At the opposite end of handle 14, is wheel 18, which is rotatably attached to handle 14 using a central axle or attachment means 19, which allows wheel 18 to rotate. Handle 14 may also include grip 13 comprised of suitable known materials.

Figure 4:
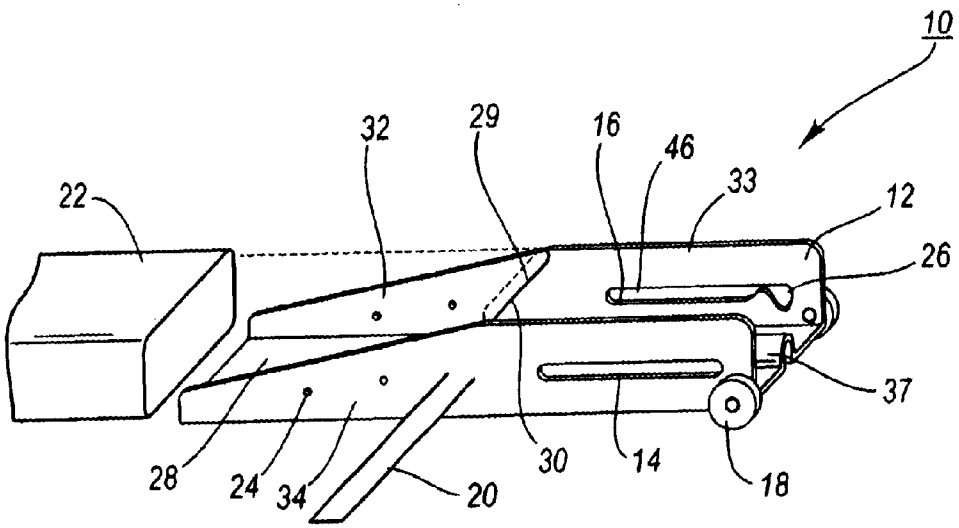
FIG. 4 illustrates detailed isometric view of another embodiment of the present invention.
Figure 5:
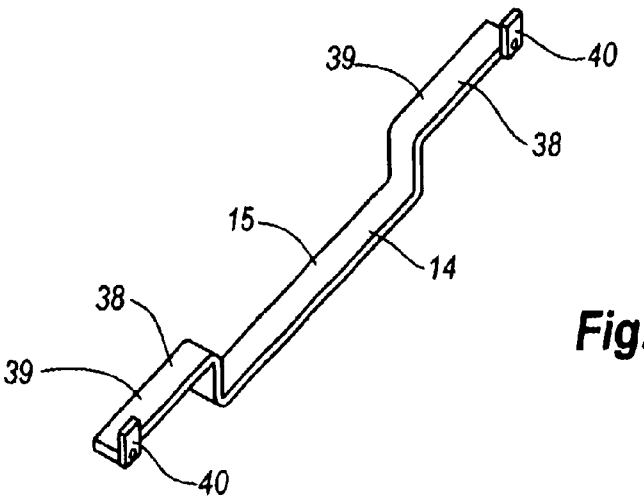
FIG. 5 illustrates one embodiment of a handle and support extensions extending therefrom.

FIGS. 4 and 5 represent another embodiment of the present invention. As shown, support housing 12 includes upper surface 33, lower surface 35, first extension 32, and second extension 34. First extension 32 and second extension 34 form a flanged portion or channel 28. Channel 28 also includes channel stop 29 serving to abut support strut 22. According to the present invention, support strut 22 is inserted into channel 28 thereby attaching support strut 22 to support housing 12 using attachment means 24. Several attachment means are available, the most common being screws, nails, and other like elements known by those in the art. In the preferred embodiment, support housing 12 is attached to support strut 22 using a series of screws or nails. Alternatively, in another embodiment first extension 32 and second extension 34 may include a plurality of projectiles that may be driven into support strut 22 after it is inserted into channel 28 using a hammer or similar device such as those members used to connect the individual boards in trusses.

Support strut 22 typically consists of a 2"×4" wooden plank consisting of any desired length. This allows the present invention to be used with any sized panel or gypsum board. Likewise, tool 10 and corresponding channel 28 is adaptable to any dimensioned support strut 22. However, the internal load bearing properties of support strut 22 must be sufficient for the load it is required to bear, namely the suspension of a piece of gypsum board.

Support housing 12 further includes an aperture 16 located on upper surface 33. Aperture 16 may consist of any suitable opening such as a slot, circle, or other shape capable of receiving a corresponding hanging member. As shown, aperture 16 includes a slotted portion extending longitudinally along surface 33 to face 37. The slotted portion further includes a slot extension 26, which extension begins at the intersection of surface 33 and face 37 and continues down a portion of face 37.

The function of slot extension 26 in this embodiment and the preferred embodiment is to allow rotation and movement of support housing 12 about hanging member 52. By employing slot extension 26, support housing 12 may rotate about hanging member 52 ranging from 0 to at least 90 degrees. Slot extension 26 allows tool 10 to achieve a full range of motion. Slot extension 26 also allows support housing 12 to be coupled to a horizontally placed hanging member 52 if needed.

Also shown in FIG. 4 is wheel 18 rotatably coupled to support housing 12.

Referring now to FIG. 5, handle 14 is shown having handle extensions 38 which extend outwardly from a mid point of handle 14 in opposing directions. Handle extensions 38 may extend from handle 14 in a longitudinal direction coplanar with handle 14, or handle extensions 38 may include a first and second upper extending portion wherein handle 14 forms a U-shape as shown in the preferred embodiment of FIG. 2. At the distal ends of handle extensions 38 are shown stoppers 40. Stoppers 40 may be rigidly connected to handle extensions 38 or they may be rotatably or slidably connected to handle extensions 38 such that stoppers 40 may move or pivot. Stoppers 40 help to secure a piece of gypsum board in place while using the gypsum board hanging tool 10 to hang gypsum board on a ceiling or a wall. The ends of a piece of gypsum board are adjacent to and abut stoppers 40 and rest on surface 39 of handle extensions 38. Handle extensions 38 provide support to a piece of dry wall or gypsum board prior to its being securely fastened to a ceiling or a wall. Handle 14 is used to grip the tool 10 and lift it into position coupling support housing 12 to a hanging member.

Figure 6:
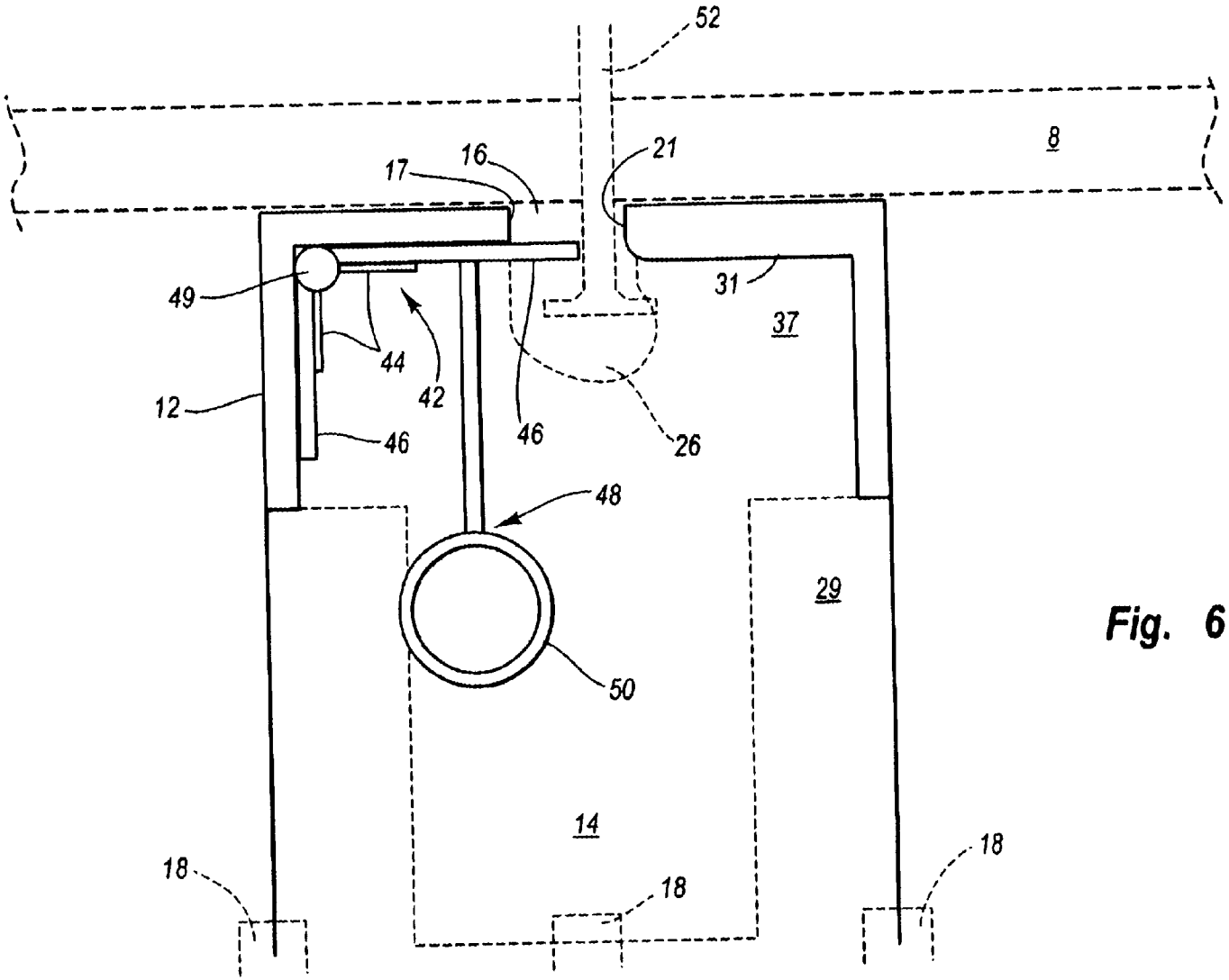
FIG. 6 illustrates a front view of the hanging tool with an overlaid piece of gypsum board thereon, and the coupling actuator of the preferred embodiment with hanging member engaged within the support housing.

In reference to FIG. 6, support housing 12 is shown enclosing or having coupling actuator 42. Specifically, coupling actuator 42 includes an engagement member 46, a biased loading member 44, and a pivot point 49. Coupling actuator 42 also includes a quick release or release mechanism 48. Release mechanism 48 is shown as a quick release having a string with a loop attached thereto, but may be any suitable means by which engagement member 46 can be deactuated to release hanging member 52 from support housing 12. Coupling actuator 42 serves to engage hanging member 52 so that the gypsum board hanging tool 10 may be suspended from the ceiling or wall. Essentially, support housing 12 is lifted into position such that hanging member 52 is inserted into or passed through aperture 16 in support housing 12, which in the preferred embodiment consists of a slotted portion or slotted member running longitudinally along the length of the upper surface of support housing 12. As hanging member 52 is passed through the slotted portion or aperture 16, it comes in contact with engagement member 44. Engagement member 44 is part of a spring loaded hinge attached to the interior surface of support housing 12 such that engagement member 46 extends from pivot point 49 outwardly along the interior of upper surface 33 and passing a substantial distance past edge 17 of aperture 16. Biased loading member 44, which is shown in the drawing as a spring loaded hinge, causes engagement member 46 to be subject to a load, thereby exerting an upward force on interior 31 of support housing 12, and ultimately to collapse around hanging member 52 securing it within support housing 12. As hanging member 52 enters aperture 16, it comes in contact with engagement member 46 as it extends past edge 17. Further extension or insertion of hanging member 52 through aperture 16 and into support housing 12 causes hanging member 52 to displace, thus actuating coupling actuator 42. Specifically, engagement member 46 is caused to rotate about pivot point 49 as the head of hanging member 52 is introduced into aperture 16 thereby causing engagement member 46 to displace. Engagement member 46 then collapses around and engages with the stem portion of hanging member 52. Hanging member 52 is securely retained within support housing 12 by engagement member 46 and edge 21 of aperture 16. In the preferred embodiment, hanging member 52 may freely move within aperture 16 as aperture 16 is a slotted portion allowing hanging member 52 to slide within the slotted portion as is needed to align gypsum board 8 to its proper place for attachment to a ceiling or a wall. Engagement member 46 is dimensioned such that hanging member 52 remains engaged at all times during movement and adjustment of support housing 12 about hanging member 52.

Also shown in FIG. 6 in phantom view is slot extension 26. Slot extension 26 allows the gypsum board hanging tool and specifically support housing 12 to freely rotate at least 90 degrees about an axis perpendicular to the central longitudinal axis of hanging member 52. Slot extension 26 also facilitates engagement of coupling actuator 42 with hanging member 52 when hanging member 52 is horizontally attached to a wall structure. This concept will be discussed in greater detail below.

Release mechanism 48 is shown attached to engagement member 46. Release mechanism 48 serves as a quick release to disengage engagement member 46 and deactuated coupling actuator 42 thereby releasing hanging member 52 from support housing 12. Specifically, release mechanism 48 is used to disengage engagement member 46 thereby allowing the head of hanging member 52 to pass back through aperture 16. Release mechanism 48 applies a reverse force to engagement member 46 wherein engagement member 46 is again displaced a distance from support housing 12. Release mechanism 48 causes engagement member 46 to displace a sufficient distance to allow the head of hanging member 52 to pass without aperture 16, wherein support housing 12 is then released from hanging member 52. At this time, release mechanism 48 is relaxed causing biased loading member 44 to return engagement member 46 to its resting position against interior surface 31.

Figure 7:
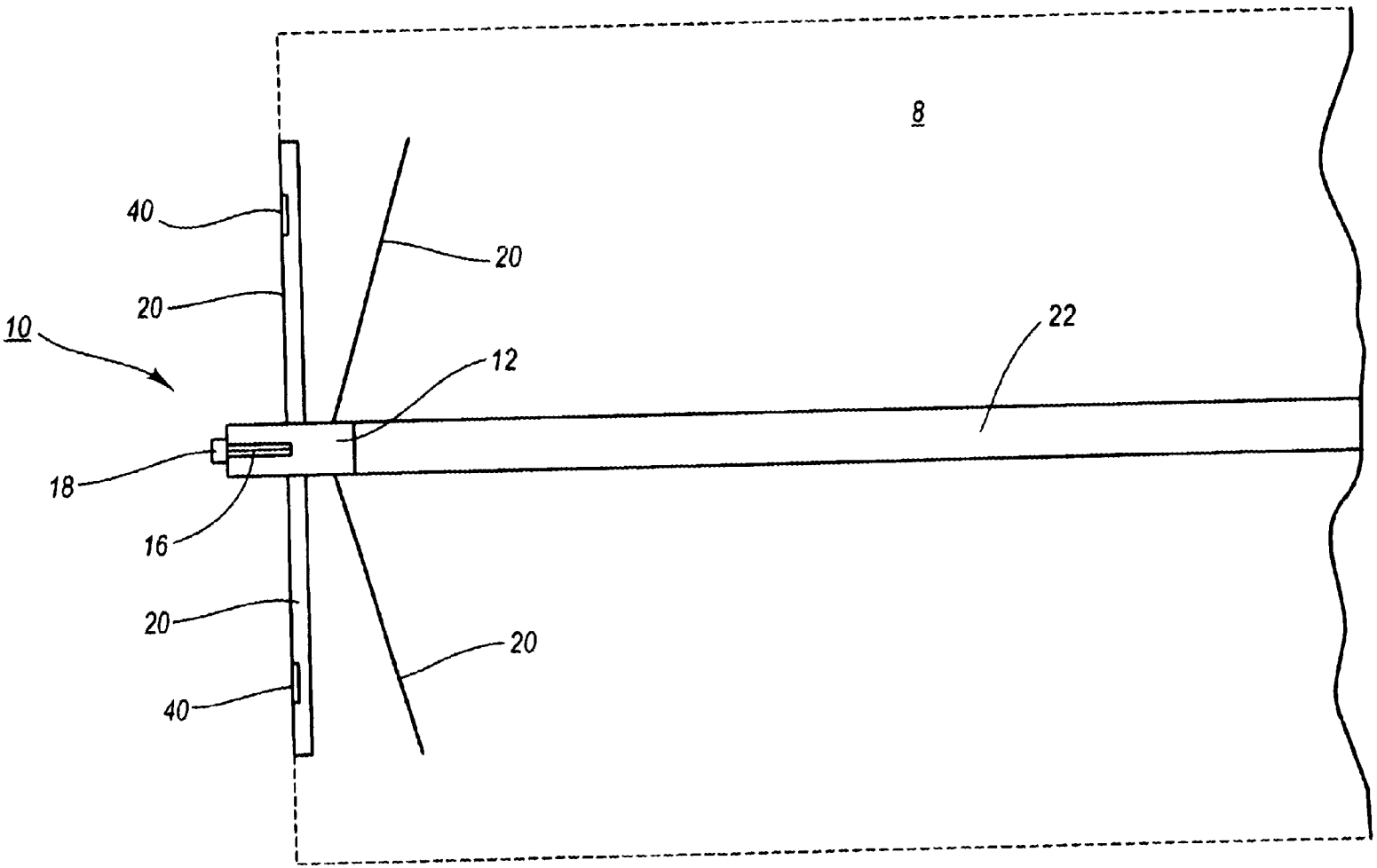
FIG. 7 illustrates a top view of the hanging tool and an overlaid piece of gypsum board thereon.

Referring now to FIG. 7, what is shown is a top view of gypsum board hanging tool 10 having a piece of dry wall or gypsum board overlaid thereon with gypsum board or dry wall shown in phantom view. As only one end of the gypsum board hanging tool is shown, the preferred embodiment of the present invention includes gypsum board hanging tool having support housing 12 and subsequent portions thereon removably attached to both sides of support strut 22. Specifically, the preferred embodiment of the present invention includes a first and second support housing 12 with associated portions thereon as described herein, each existing on opposing ends, or first and second ends, of support strut 22. FIG. 7 illustrates how gypsum board 8 is supported upon and within gypsum board hanging tool 10. Specifically, gypsum board 8 rests on handle extensions 38, optional stabilizers 20, as well as support strut 22 gypsum board 8 may also be supported by or rest upon upper surface 33 of support housing 12. In another embodiment, gypsum board hanging tool 10 may include a recessed upper surface 33 of support housing 12 such that gypsum board 8 does not rest upon or come in contact with support housing 12.

As shown in FIG. 7, a plurality of stabilizers 20 may be used to aid in the support of gypsum board 8 while only two of such stabilizers are shown in FIG. 7. Any number of stabilizers 20 may be used along gypsum board hanging tool 10 to provide support to gypsum board 8. Also, the orientation of stabilizers 20 may vary depending on specific needs.

Handle extensions 20 protrude substantially perpendicular to support housing 12. Any length of handle extensions 20 may be used as long as sufficient support is provided to the piece of gypsum board 8 overlaid thereon. In addition, stoppers 40 may be placed upon the length of handle extensions 20 at any distance capable of securing and holding gypsum board 8 in place while the gypsum board hanging tool is being used.

FIG. 7 also illustrates the ease of using gypsum board hanging tool 10. Once support housing 12 is attached to both ends of support strut 22, a piece of gypsum board 8 is simply laid upon the gypsum board hanging tool 10 and fit between stoppers 40 on either side of the gypsum board hanging tool. Once the piece of gypsum board 8 is securely within gypsum board hanging tool 10, the entire system may then be used by a single individual to hang gypsum board on a ceiling.

Single wheel 18 is depicted in FIG. 7 as being rotatably attached to support housing 12. Wheel 18 serves to function as a means for allowing gypsum board hanging tool system to be freely moved along the floor during the hanging process as needed.

Figure 8:
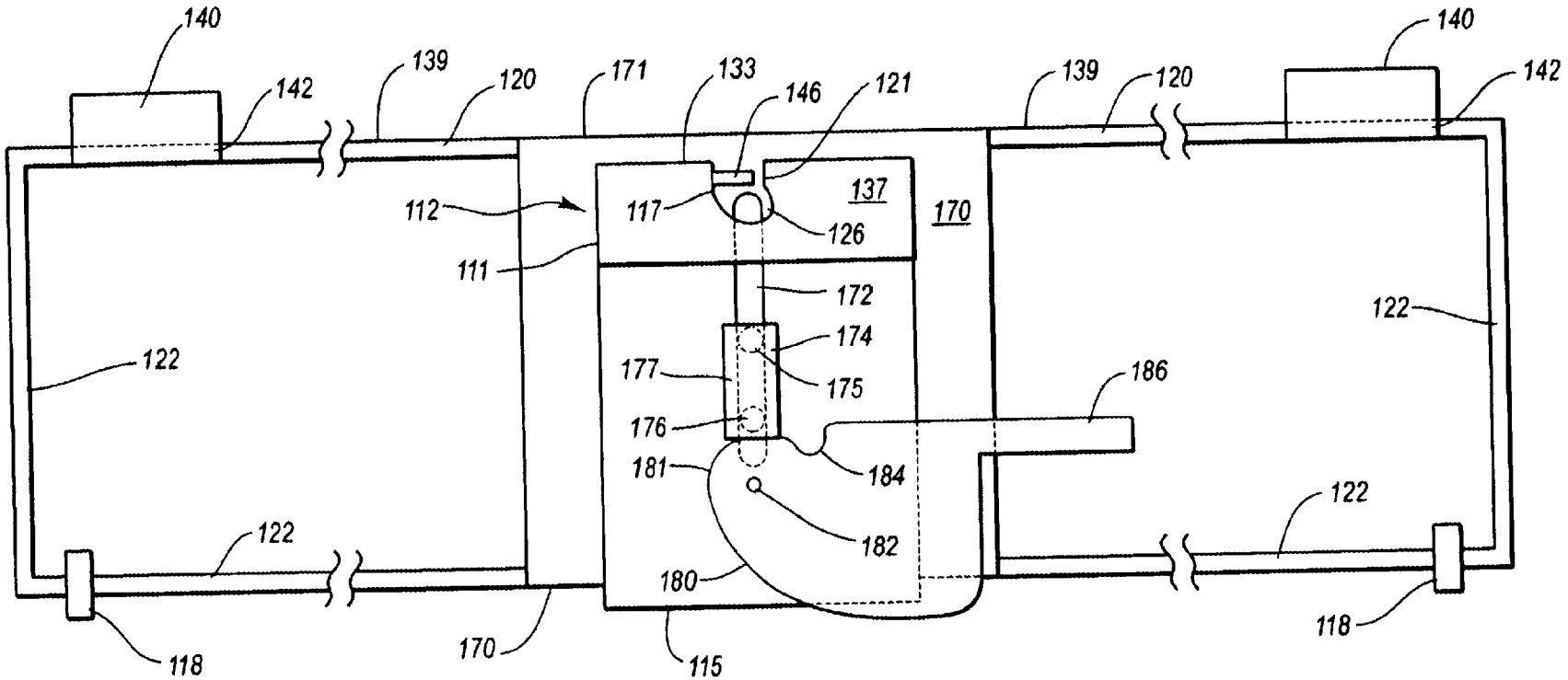
FIG. 8 illustrates another embodiment of the present invention wherein a cam actuator is used to securely fasten a piece of gypsum board to the ceiling.

FIG. 8 illustrates another embodiment of the present invention. As shown, support housing 112 is a separate structure and not is integrally connected with channel and the channel stop that accepts support strut as described and shown in the previous embodiments. Rather, FIG. 8 shows a receiver 170 that does include a channel 128 and a channel stop 129 for receiving support strut 22 (channel 128 and channel stop 129 not actually shown, but functioning as described above). Receiver 170 includes an upper surface 171 that is parallel with stabilizers 120 used to support a piece of sheet rock. Stabilizers 120 extend outwardly from receiver 170 in opposing directions and also include stabilizer extensions 122, which are shown in the form of L-shaped extensions that connect to a lower portion of receiver 170. Stabilizer extensions may comprise any suitable shape allowing them to perform their intended function of supporting a piece of gypsum board and supporting a wheel structure. Included on stabilizer extensions 122 are wheels 118 on either side of receiver 170. Wheels 118 perform similar functions as wheels 18 described in earlier embodiments.

Stoppers 140 are also shown coupled to stabilizers 120. However, in the embodiment shown in FIG. 8, stoppers 140 include a spring mechanism 142 coupled to stoppers 140, which allow stoppers 140 to pivot or slide in a downward direction as a vertical force is applied downward to stopper 140. In doing so, stopper 140 may be lowered down and out of the way as needed.

Support housing 112 also comprises an upper portion 111 and a lower portion 115. Upper portion 111 includes an upper surface 133 that performs a similar function as upper surface of support housing 12 in the prior embodiments. Also included in upper surface 111 is aperture 116. Aperture 116 may be a slot or any other shape as described above, which allows support housing 112 to receive a hanging member and function according to the technology described herein. Support housing 112 and upper portion 111 also includes slot extension 126 that extends down face 137 of upper portion 111. Slot 126 includes edges 117 and 121, which perform similar functions as described above. Shown within slot extension 126 is engagement member 146. Engagement member 146 is part of a coupling actuator and release mechanism and functions also as described above.

Support housing 112 further comprises a slotted portion 172, which extends along lower portion 115. Support housing 112 is slidably coupled to receiver 170 using securing means 174. Securing means 174 includes guide members 175 and 176, which are rigidly fixed to receiver 170 and extend upwards through slot 172 to allow support housing 112 to move relative to receiver 170. Securing means 174 also includes a stopping member 177 that is attached to guide means 175 and 176. Stopping member 177 securely fastens support housing 112 to receiver 170 while still allowing support housing 112 to slide with respect to receiver 170. Support housing 112 is able to slide along receiver 170 as securing means 174, and particularly guide members 175 and 176, track along slot 172. It would be recognized by one ordinarily skilled in the art that support housing 112 may be slidably attached to receiver 170 using various means. What is critical is that support housing 112 is capable of sliding with respect to receiver 170. The purpose of this function is described in greater detail below.

Also shown in FIG. 8 is cam actuator 180. Cam actuator 180 is rotatably fixed to the lower portion of support housing 112 using attachment means 172. Cam actuator 180 operates or functions such that cam actuator 180 may pivot about the centroidal axis inherently located within attachment means 182. Cam actuator 180 includes a recess 184, which is designed to receive guide member 176 when cam actuator 180 is in a first position. In this first position, upper surface 133 of support housing 112 is parallel and co-planar with upper surface 171 of receiver 170.

As support housing 112 is coupled to a hanging member securely fastened in a ceiling joist or other member, hanging member 152 is securely coupled within support housing 112 using engagement member 146 as described more fully above in the prior embodiments. As the sheet rock hanging tool of the present invention, equipped with the piece of gypsum board, is brought into place and suspended from the ceiling, the piece of sheet rock is allowed to be manipulated and moved into proper position prior to its attachment to the ceiling. Once the sheet rock has been moved into a proper position, cam actuator 180 may be utilized to facilitate lifting the piece of sheet rock to the ceiling and pressing the piece of gypsum board to the ceiling. This is accomplished by rotating cam actuator 180 about the pivot point and centroidal axis of attachment means 182. As cam actuator 180 is rotated, guide member 176 is caused to displace from within recess 184. Upon further rotation, cam actuator 180 and outer cam surface 181 tracks along guide member 176. As rotation continues, cam actuator 180 causes support housing 112 to slide or move in a downward direction with respect to receiver 170. This movement is in direct relation to the attachment of cam actuator 180 to lower portion 115 of support housing 112 and fixed relationship of guide member 176 to receiver 170. As cam actuator 180 is caused to rotate, thereby forcing support housing 112 to slide in an opposing direction with respect to receiver 170, a tension force is created within hanging member 152. The tension force in hanging member 152 is generated as hanging member 152 is coupled within support housing 112 at one end and securely fastened into a ceiling joist at its other end. Because support housing 112 is caused to slide in an opposing direction with respect to receiver 170, and as support housing 112 is coupled to hanging member 152, the resulting action is that receiver 170 moves in an upward direction towards the ceiling joist. As such, the piece of gypsum board that is contained and supported by the sheet rock hanging tool of the present invention is lifted and pressed against the ceiling joist, wherein it may be securely fastened or attached. Varying amounts of pressure may be applied by rotating cam actuator 180 in the appropriate direction.

In addition, cam actuator may include means for providing several interim positions wherein cam actuator may be retained in a specific position, thereby applying a constant force to the piece of gypsum board as it is pressed against the ceiling joist. This may be accomplished using means such as a spring biased ratchet and release system, a latch and catch mechanism, etc., the purpose being to allow cam actuator to be rotated to a specific location and retained in that position without requiring user assistance. Using an interim position system, cam actuator would also utilize a release mechanism to allow cam actuator to return to its initial, or other, positions.

By using the technology as described herein, a piece of sheet rock may be lifted into place, manipulated into position and pressed upon and firmly held against a ceiling joist for simple and easy attachment. Cam actuator 180 may be incorporated into any one of the embodiments as described herein.

Figure 9:
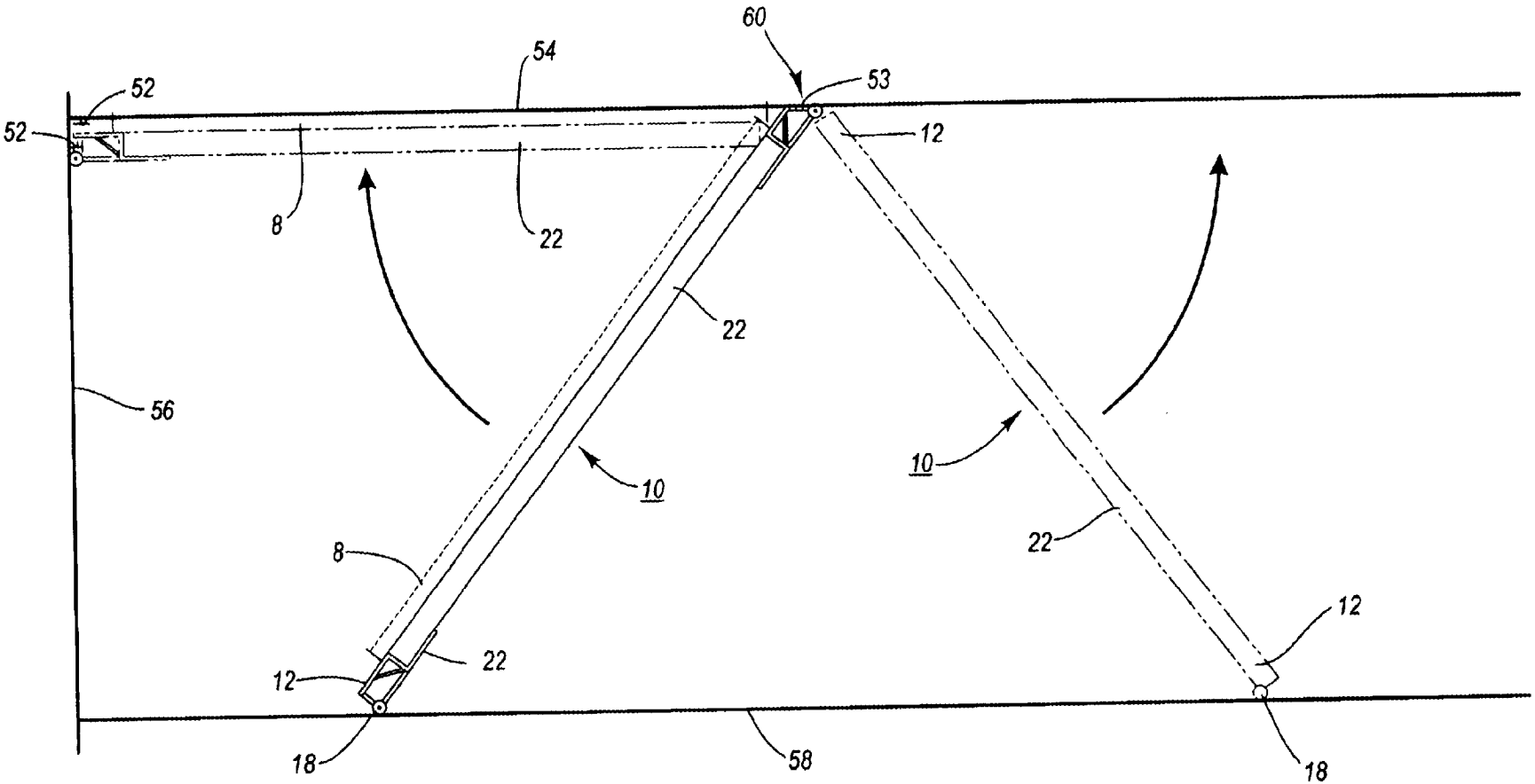
FIG. 9 illustrates the gypsum board hanging tool as it is used to hang a piece of gypsum board on a ceiling; also illustrated is the swivel characteristics exhibited by the gypsum board hanging tool wherein multiple pieces of gypsum board may be hanged.

FIG. 9 shows gypsum board hanging tool 10 as it is used to attach a piece of gypsum board 8 to a conventional or flat ceiling 54. Specifically, FIG. 9 shows how several pieces of gypsum board can be hung on the ceiling by a single person using the gypsum board hanging tool 10. The piece of gypsum board 8 represents a first piece of gypsum board to be attached to ceiling 54. Support housing 12 is used to attach gypsum board hanging tool 10 to first hanging member 52 and second hanging member 53, respectively as discussed above. First hanging member 52 supports a first support housing 12 at one end of gypsum board hanging tool 10, and hanging member 53 supports a second support housing 12 at the opposing end of gypsum board hanging tool 10, thereby suspending gypsum board 8 from ceiling 54 prior to attachment. As first support housing 12 is lifted and coupled to first hanging member 52, second support housing 12 of the opposing end may then be lifted and coupled to second hanging member 53 gypsum board 8, as now suspended from ceiling 54, may then be manipulated or adjusted into a proper and accurate final position and then attached using conventional attachment means to secure gypsum board 8 to ceiling 54. Upon completion of attaching gypsum board 8 to ceiling 54, first support housing 12 may be released from first hanging member 52 using release mechanism 48 as described above. After first support housing 12 is released from first hanging member 52, it may be lowered to floor 58 resting upon wheel 18. At this time, gypsum board hanging tool 10 may be swivelled around and brought into a second position to receive a second piece of gypsum board as is shown by the phantom lines in FIG. 9. Second support housing 12 remains attached to second hanging member 53 and is allowed to swivel about hanging member 53 to enable positioning for a second piece of gypsum board. Once in a second position, a second piece of gypsum board may then be placed upon gypsum board hanging tool 10. Once the second piece of gypsum board is securely in place within gypsum board hanging tool 10, first support housing 12 may then be lifted off the floor and coupled to third hanging member 55. The second piece of gypsum board may then be attached to ceiling 54, similar to the first piece as described above. This procedure may be repeated as often as necessary to hang any number of pieces of gypsum board.

The design of the present invention allows a first piece of gypsum board and a second piece of gypsum board to be hung adjacent one another such that their edges abut each other. This is due to the pivoting stoppers employed on stabilizers 20, as discussed above, and the adjustability of support housing 12 about hanging member 52. Specifically, a first piece of gypsum board may be brought into place using the tool of the present invention as described herein. Upon suspending the first and second support housing's from first and second hanging members, stoppers may be rotated down and out of the way, if necessary, allowing the workman to fit the piece of gypsum board into its proper place. The hanging tool allows accurate placement of a piece of gypsum board into comers, along edges, and to any ceiling structure, either horizontal or inclined. The tool also allows accurate placement of a second piece of gypsum board adjacent a first piece. Upon attachment of a first piece of gypsum board to a ceiling, a second piece may be brought to abut the first piece. The hanging member does not create a problem because of the gypsum makeup of gypsum board. The edges of the first and second pieces of gypsum board may be abutted as the portion around the hanging member partially gives way. This can later be covered using the masking methods common in the industry. Upon hanging the second piece and releasing the hanging tool from the hanging member, each hanging member can be driven home into the ceiling or removed. If driven home, they too may be covered by the masking. As such, given the adjustability of the tool, namely the adjustability of the support housing's about the hanging members due to the aperture and slot extension, and the ability to manipulate the actual piece of gypsum board after suspension, a workman will not be limited to certain building structures and/or floors, but may use the tool in most situations.

Also evident from FIG. 9 is the feature of the present invention that no obstructions to the user of the gypsum board hanging tool exists. Specifically, no elements are required to be supported from the ground. This provides a great amount of freedom and latitude for the user while hanging several pieces of gypsum board. This is a great advantage over prior art gypsum board hanging tools in that the user does not have to worry about walking around or bumping into specific objects, which would could cause misalignment of the gypsum board as it is being hung, or destruction of the piece of gypsum board, or injury to the worker. Moreover, a single user is able to use the gypsum board hanging tool of the present invention with relative ease and efficiency.

Figure 10:
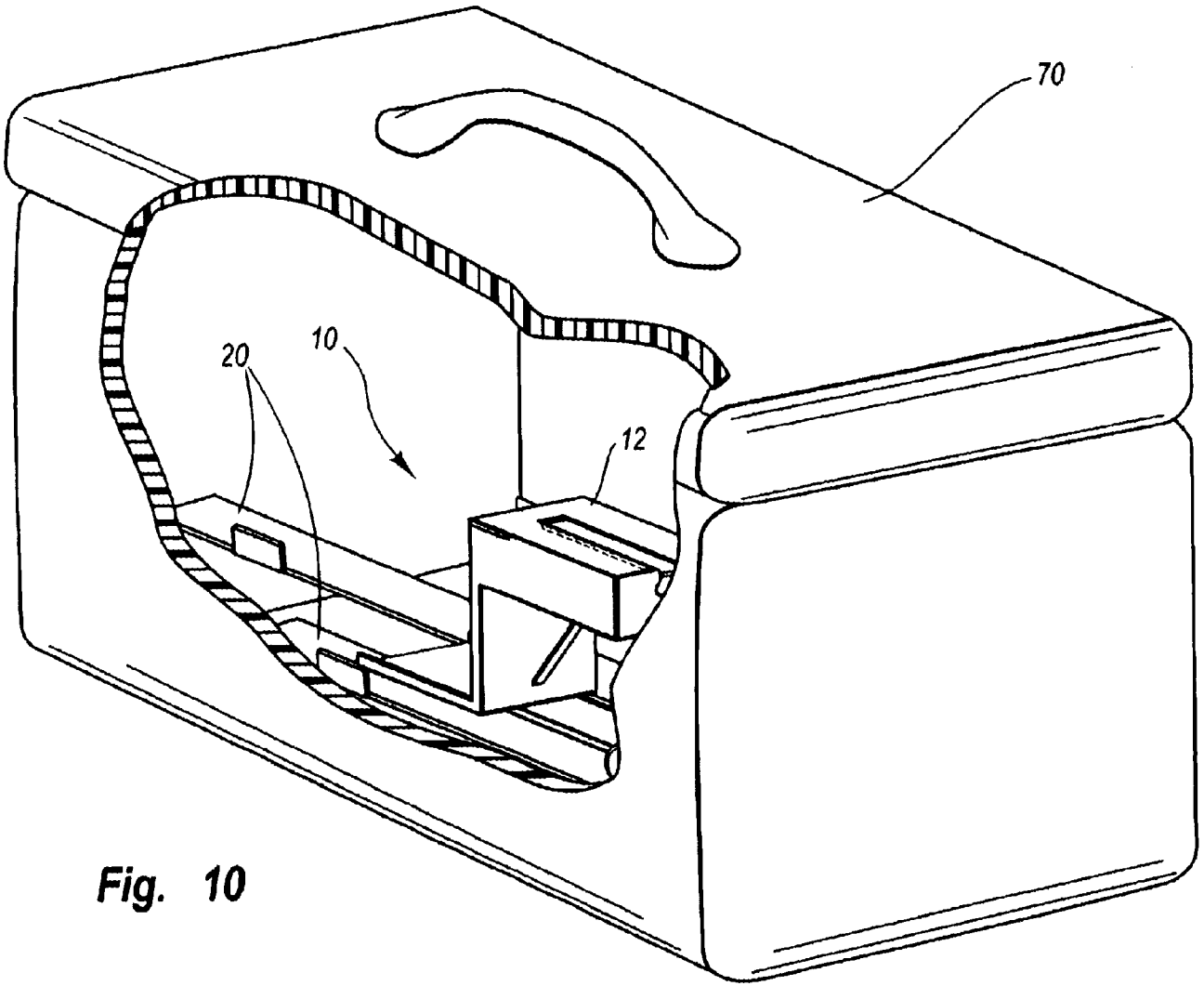
FIG. 10 illustrates the portability of the present invention, and how it may be collapsed and carried in a standard tool box.

FIG. 10 shows the portability of gypsum board hanging tool 10. Specifically, support strut 22 is removed from support housing 12. Also, stabilizers 20 are removed from support housing 12. Each of these may then be placed into a standard tool box 70 or other cargo area for storage and transportation to another job site.

Figures 11, 11A:
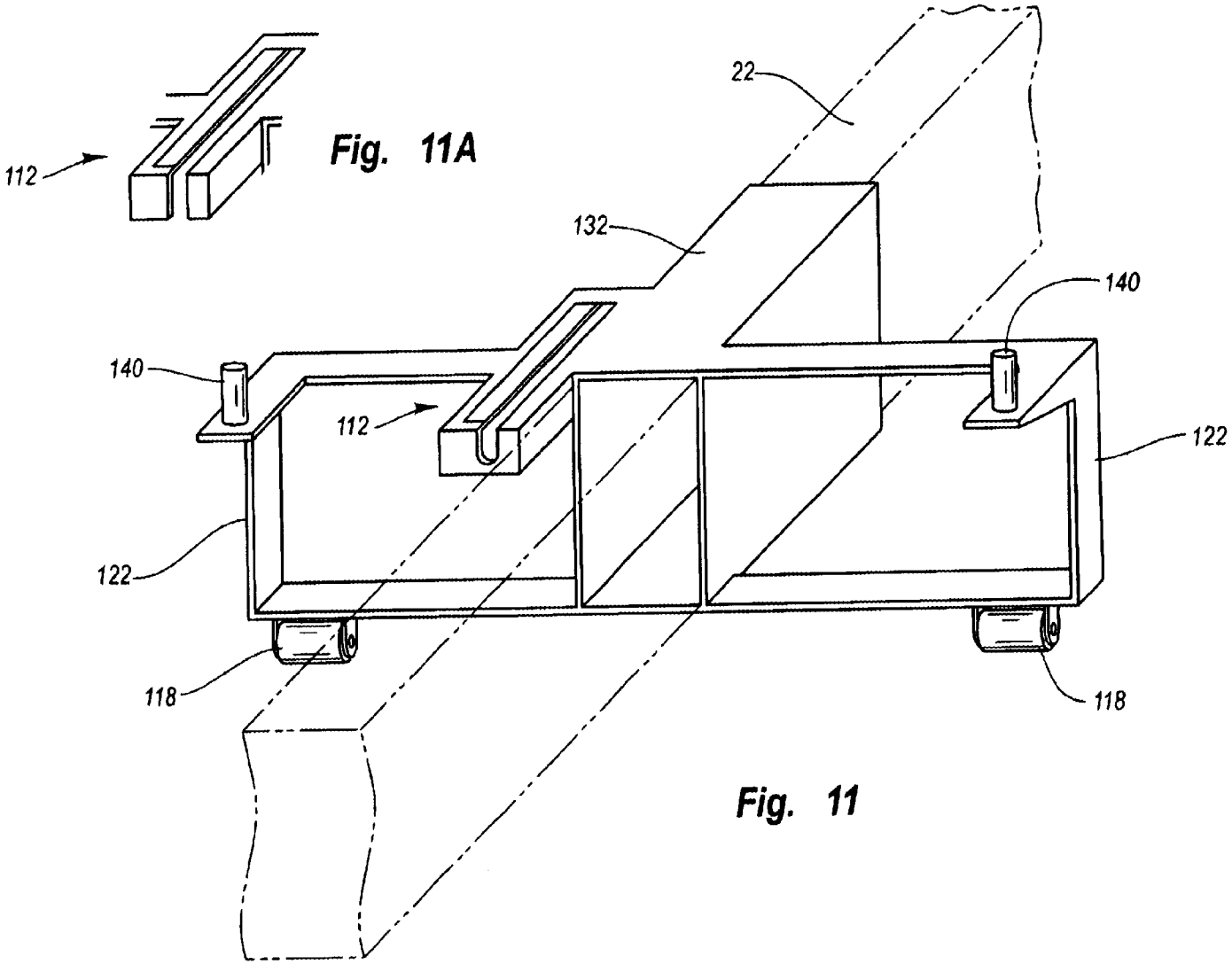
FIG. 11 illustrates an isometric view of another embodiment of the current invention where in the method of attachment allows the support housing to slide longitudenally along the support strut.

FIG. 11 illustrates another embodiment of the present invention shows support housing 112 connected to collar 132 that slidably accepts support strut 22 in such a manner the collar 132 is free to slide longitudinally along support strut 22. Also shown are stopper 140, wheels 118 and handle 122. The present invention also features a method for hanging a paneled member. In a preferred embodiment, the paneled member is a piece of drywall or gypsum board. The method includes the following steps:

First, inserting a first and second hanging member into a ceiling or wall member of a building structure having supporting joists, rafters, studs, or other framing members. Hanging members may be nails, screws, or any other type of attachment means known by those in the art and capable of supporting a weighted structure and capable of fitting with the support housing as described below. These members may be inserted at any location wherein a piece of gypsum board is needed as taught herein.

Second, overlaying the gypsum board onto a gypsum board hanging tool. The gypsum board hanging tool having a first and second support housing which are both removably attached to opposing ends, or first and second ends, of a support strut; an aperture for receiving the above-mentioned hanging member; a coupling actuator located within and attached to the first and second support housing, the coupling actuator engaging the first hanging member within the support housing; and optional stabilizers removably attached to and extending from the support housing or support strut for supporting the gypsum board. The gypsum board is secured within stoppers that are rotatably or slidably attached to the stabilizers on each end of the hanging tool. These stoppers may be rotated or pushed down out of the way thus enabling the user to accurately position the gypsum board and permanently attach it to the ceiling.

Third, positioning the gypsum board hanging tool to a first position. One of the advantages of the present invention is its ability to be manipulated and adjusted both when on the floor and when suspended from a ceiling. As one end of the tool is lifted to a first hanging member, the second end, still upon the ground, may freely move as is needed to properly position the tool. The wheel, acting in conjunction with the support strut, functions like a dolly to the piece of gypsum board secured within the tool. Using the tool in this manner provides an easy way to translocate the piece of gypsum board from one location to another.

Fourth, lifting the gypsum board hanging tool and overlaid gypsum board to the first hanging member. Once the piece of gypsum board is wheeled to the general vicinity of where it will be hanged, it may be lifted to the first screw.

Fifth, coupling the first support housing to the first hanging member using the coupling actuator. As the support housing is lifted and placed over the first hanging member, the coupling actuator is activated thereby coupling the hanging member to the support housing and suspending one end of the tool and the piece of gypsum board from the ceiling. This is repeated for the second end of the tool in a like manner. Once both ends are coupled to the hanging member, the entire gypsum board hanging tool and piece of gypsum board are suspended from the ceiling via first and second screws.

Sixth, manipulating the gypsum board hanging tool and the gypsum board to a proper position. After suspending the tool and gypsum board, the piece of gypsum board may be manipulated or adjusted to its proper final position prior to permanent attachment. This is accomplished in several ways. The entire tool may be moved as force is applied to the tool causing the hanging members to slide back and forth within the aperture or slotted portion. The cam system may be used to press the gypsum board firmly against the ceiling. Also, the stoppers holding the gypsum board in place may be rotated down and out of the way so that the panel may be slid past the stoppers if necessary.

Finally, permanently attaching the gypsum board to the ceiling. Once in position, the panel may be attached to the ceiling using known attachment means.

The method of the preferred embodiment of the present invention further includes the steps of inserting a third hanging member into said ceiling; releasing said first support housing from said first hanging member using the release mechanism of the coupling actuator; swiveling said gypsum board hanging tool to a second position; overlaying a second piece of gypsum board onto the gypsum board hanging tool; lifting the first support housing to the third hanging member; and coupling the first support housing to the second hanging member using the coupling actuator, thus suspending the gypsum board hanging tool and the gypsum board from the ceiling using second and third hanging members. These steps may be repeated as often as necessary to hang a plurality of paneled members on any conventional or inclined type of ceiling.

Upon completion of the job and after all pieces of gypsum board are hanged, the gypsum board hanging tool may be collapsed to fit into a standard toolbox. Specifically, the coupling actuator is deactuated using the release mechanism or quick release. This causes the engagement member of the coupling actuator to disengage thereby releasing the support hanging from the hanging member. The plurality of stabilizers may then be removed from the support housing, followed by the removal of each support housing from the support strut. This provides a compact, easy to install and takedown portable hanging tool.

FIG. 11A illustrates an alternative embodiment in which the screw may enter from the bottom or the top.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed is:

1. A gypsum board hanging tool and system, comprising:

a support housing having an upper and lower surface and a face, said support housing comprising:

an aperture in said upper surface, said aperture capable of receiving within said support housing a hanging member attached to a ceiling, said hanging member allowing said support housing to be adjusted and to swivel about said hanging member; and a coupling actuator located within and attached to said support housing, said coupling actuator capable of engaging and securing said hanging member within said support housing, wherein said support housing may be coupled to said hanging member, thus suspending said gypsum board hanging tool and system from said ceiling; and means for removably attaching said support housing to a support a strut.

2. The gypsum board hanging tool of claim 1, further comprising a wheel rotatably attached to said support housing.

3. The gypsum board hanging tool of claim 1, wherein said aperture comprises a slotted portion extending longitudinally from said face of said support housing along said upper surface.

4. The gypsum board hanging tool of claim 3, wherein said slotted portion further includes a slot extension extending therefrom and down said face of said support housing.

5. The gypsum board hanging tool of claim 1, wherein said coupling actuator includes an engagement member moveably coupled to said support housing, said engagement member subject to a biased loading member, said engagement member capable of displacing a distance suitable for engaging said hanging member as said hanging member is inserted through said aperture of said support housing.

6. The gypsum board hanging tool of claim 5, wherein said coupling actuator further comprises a release mechanism coupled to said engagement member or biased loading member for releasing said engagement member from said hanging member, thus releasing said gypsum board hanging tool and system from said hanging member.

7. The gypsum board hanging tool of claim 1, wherein said support housing is removably attached to a first end of said support strut.

8. The gypsum board hanging tool of claim 1, further comprising a handle extending from said support housing.

9. The gypsum board hanging tool and system of claim 1, wherein said means for attaching said support housing to said support strut allows said support housing to slide the length of said support strut while preventing said support housing from becoming detached from said support strut.

10. A method for hanging paneled members on a ceiling, said method comprising the steps of:

inserting a first and second hanging member into said ceiling;

overlaying said paneled member onto a gypsum board hanging system, said gypsum board hanging system comprising:

first and second gypsum board hanging tools removably attached to opposing ends of a support strut, said first and second gypsum board hanging tools each comprising:

a support housing;

an aperture for receiving said first and second hanging members, respectively;

a coupling actuator located within and attached to said support housing, said coupling actuator engaging said first hanging member within said support housing; and at least one stabilizer removably or permanently attached to and extending from said support housing for supporting said paneled member;

positioning said gypsum board hanging system and said paneled member in a first position;

lifting said gypsum board hanging tool and overlaid paneled member to said first hanging member;

coupling said second support housing to said second hanging member using said coupling actuator;

lifting said second support housing to said second hanging member;

coupling said second support housing to said second hanging member using said coupling actuator, thus suspending said gypsum board hanging system and paneled member from said ceiling using said first and second said gypsum board hanging tools;

manipulating said gypsum board hanging system and said paneled member to a proper position; and permanently attaching said paneled member to said ceiling.

11. A gypsum board hanging tool and system, comprising:

a receiver capable of receiving and coupling a support strut, said receiver also supporting a piece of gypsum board;

a support housing slidably coupled to said receiver, said support housing capable of engaging and securing a hanging member within said support housing to suspend said system and said piece of gypsum board from a ceiling; and a cam actuator rotatably coupled to said support housing, said cam actuator causing said support housing and said receiver to slide in opposing directions with respect to one another, such that said piece of gypsum board may be pressed and held against said ceiling.

12. The gypsum board hanging tool and system of claim 11 further comprising a handle with stoppers attached thereto.

13. The gypsum board hanging tool and system of claim 12, wherein said stopper comprises a spring mechanism enabling said stopper to slide away from obstructing said piece of gypsum board while being manipulated into position for hanging.

14. The gypsum board hanging tool and system of claim 11, wherein said support housing further comprises:

an upper and lower surface and a face;

an aperture in said upper surface, said aperture capable of receiving within said support housing a hanging member attached to a ceiling, said hanging member allowing said support housing to be adjusted and to swivel about said hanging member; and a coupling actuator located within and attached to said support housing, said coupling actuator capable of engaging and securing said hanging member within said support housing, wherein said support housing may be coupled to said hanging member, thus suspending said gypsum board hanging tool and system from said ceiling.

15. The gypsum board hanging tool and system of claim 11, wherein said support strut is removably attached to said support housing at opposing ends of said support strut.

16. The gypsum board hanging tool and system of claim 15, wherein said support strut further comprises means for telescoping.

17. The gypsum board hanging tool and system of claim 11, wherein said cam actuator includes a recess for accepting a guide member in a first position.

18. The gypsum board hanging tool and system of claim 17, wherein said guide member is fixed to said receiver, such that said cam actuator tracks along said guide member to cause said support housing to move relative to said receiver.

19. The gypsum board hanging tool and system of claim 11, further comprising one or more wheels rotatably attached said handle or receiver.

20. The gypsum board hanging tool and system of claim 11, wherein said cam actuator further comprises means for retaining said cam actuator in at least one interim position, allowing said piece of gypsum board to maintain a constant force against a ceiling.

* * * * *